US006305750B1

(12) United States Patent
Buono et al.

(10) Patent No.: US 6,305,750 B1
(45) Date of Patent: Oct. 23, 2001

(54) CLAMSHELL BACKREST COMPONENTS

(75) Inventors: Steven A. Buono, Greeneville; Eric A. Ward, Telford, both of TN (US)

(73) Assignee: MECO Corporation, Greeneville, TN (US)

( * ) Notice: Subject to any disclaimer, the term of this patent is extended or adjusted under 35 U.S.C. 154(b) by 0 days.

(21) Appl. No.: 09/310,308

(22) Filed: May 12, 1999

(51) Int. Cl.[7] ..... A47C 7/00

(52) U.S. Cl. ..... 297/440.2; 297/440.1; 297/440.14

(58) Field of Search ..... 297/440.2, 440.1, 297/440.14, 440.15, 440.22, 452.65, 463.1

(56) References Cited

U.S. PATENT DOCUMENTS

| | | | | |
|---|---|---|---|---|
| D. 13,405 | | 11/1882 | Paine . | |
| D. 124,217 | | 12/1940 | Bales . | |
| D. 357,365 | | 4/1995 | Ward et al. | D6/368 |
| D. 357,369 | | 4/1995 | Klein | D6/380 |
| 2,281,902 | | 5/1942 | Witz | 155/196 |
| 2,302,969 | | 11/1942 | McMahan | 155/194 |
| 2,440,470 | * | 4/1948 | Greitzer | 297/440.2 X |
| 2,628,668 | | 2/1953 | Basile | 155/196 |
| 2,865,437 | | 12/1958 | Shwayder | 155/186 |
| 2,877,829 | | 3/1959 | Ferar et al. | 155/142 |
| 3,054,156 | | 9/1962 | Cohen | 24/73 |
| 3,095,357 | | 6/1963 | Shwayder | 297/452 |
| 3,245,715 | | 4/1966 | Gits | 297/59 |
| 3,610,685 | | 10/1971 | Lay | 297/231 |
| 3,695,687 | | 10/1972 | Uyeda | 297/56 |
| 4,332,419 | | 6/1982 | Vogel | 297/443 |
| 4,900,085 | | 2/1990 | Tobler | 297/219 |
| 5,064,247 | * | 11/1991 | Clark et al. | 297/440.22 X |
| 5,779,317 | | 7/1998 | Neal | 297/440.2 |
| 5,820,221 | * | 10/1998 | Greaves et al. | 297/440.2 X |
| 5,842,264 | * | 12/1998 | Roossien et al. | 297/440.2 X |
| 6,014,783 | * | 1/2000 | Collier et al. | 297/440.2 X |

* cited by examiner

*Primary Examiner*—Laurie K. Cranmer
(74) *Attorney, Agent, or Firm*—Roberts Abokhair & Mardula LLC

(57) ABSTRACT

A backrest for a chair comprising two parts constructed and arranged to interlock around chair back supports. Each part is preferably molded, and has a rib structure which provides positioning means for assembly on the supports. A hook and hook receiver arrangement provide a locking means for firm attachment of the parts to the supports. Decorative cushions can be applied to the parts before or after locking them to the supports. The invention is not limited to folding chairs.

27 Claims, 7 Drawing Sheets

CLAMSHELL BACKREST COMPONENTS

BACKGROUND

The present invention relates generally to a folding chair having backrest components of varying designs that can be added by the user. More particularly, the present invention relates to a method and apparatus to add a cushioned backrest to a folding chair that has a metal frame or a hard backrest construction.

Chair manufacturers typically manufacture and assemble chairs and their component parts at the factory. The basic construction starts with a colored chair frame and a solid seat and a backrest frame. An option is to include a cushioned seat. As far as the backrest, various options are known. One option is to include a solid back piece along the top portion of the chair frame. Other options include a backrest design that is contoured. The contoured design is either solid, tubular, or any combination thereof.

Keeping the above in mind, one can clearly see that the possible combinations are large even before considering the fabric options for a cushioned seat or cushioned back. For inventory control reasons, a manufacturer would desire to leave the consumer with as many options as possible while reducing the amount of inventory required for each option.

Another concern of manufacturing several different chair designs is the manner in which the chairs are stored. In order to store several different chair designs, retail stores require a tremendous amount of storage space. Needless to say, the retailer would also need a vast amount of showroom space to display all of the chair design components. This would be both impractical and extremely costly to the manufacturer and retailer. In essence, these shortcomings would be passed to the consumer in higher prices for those chairs.

If a manufacturer could offer just one option to be added by the consumer, this would reduce in half the amount of inventory carried or displayed by the retailer. This also reduces the amount of inventory carried by the manufacturer. An option to add a cushioned backrest at the retail store or by the consumer would further allow the consumer to purchase the lower cost item without the cushioned back and later add the upgrade. Optionally, a manufacturer or retailer can offer twice the options with the same level of inventory.

Examples of folding chairs that are constructed with a solid or framed backrest are shown in U.S. Design Pat. No. 357,365 to Ward et al. and assigned to Meco corporation. Another example is found in U.S. Pat. No. 2,877,829 to Ferar et al. The backrest design of the present invention is applicable to any chair with a backrest that is not completely solid.

It is also desirable to provide an easy method for the addition of the backrest components similar to those of the present invention. In many instances special tools and skills are required to properly accomplish this tasks. It is desirable to provide a method that does not require any tools or special skills.

Several inventors have attempted to devise methods for the construction of chairs. These methods, however, are complex such that a consumer without special tools and skills would not be able to assemble the backrest to the chair frame. Additionally, even if the consumer was able to assemble the chair there are no known manufacturers that separately sell chair frames and backrest components to the consumer.

U.S. Pat. No. 5,382,080 to G. Gamberini et al. discloses a chair having a base and seating structure. The base and seating structure are assembled via a coupling device accomplished by a pin and screw assembly. The seating structure consists of a four part frame having a seat structure, backrest structure, and a pair of L-shaped connecting means. The backrest structure comprises a backrest and a U-shaped frame having two tubular side members.

Several inventors have also devised methods of attaching chair seats and back supports to tubular chair frames. Typically, these methods comprise a complicated method of manufacturing that would be too costly to produce. For example, U.S. Pat. Nos. 2,306,878, 2,461,055 and 2,668,584 to M. Greitzer all disclose a method of attaching a seat and back support to a chair frame using a complex arrangement of spring loaded channels. Variations of this theme disclose supports having flanges that fit securely against the chair frame and are attached by means of screws or hooks. Other variations include a connector insert bar that has a spring latch, which is adapted to enter the ends of the chair frame.

Similar to the M. Greitzer disclosure are U.S. Pat. No. 2,281,902 to S. R. Witz and U.S. Pat. No. 5,253,923 to L. Gootee. The '902 patent to S. R. Witz discloses a chair frame having bent tubular members defined as back posts, seat supporting members, and a base frame. The back posts are flattened so that a backrest having rectangular apertures can communicate therein. The seat portion is attached to the seat supporting members by a screw assembly. The '923 patent to L. Gootee discloses an automotive type seat having a backrest and a seat. A pair of rigid coupling bars is secured to a seat base frame so that the backrest can be attached thereto.

Other means of fastening seats and chair supports to chair frames include clip or screw and flange mechanisms. For instance, U.S. Pat. No. 3,245,715 to J. C. Gits discloses a folding tube frame chair with a snap-on chair seat and backrest. Integrally molded to the chair seat and backrest are split sleeve clips which attach to the chair frame. The split sleeve clips further serve as locking devices for the folding legs.

Additionally, U.S. Pat. No. 3,054,156 to M. R. Cohen discloses a fastening clip. The clip secures a chair seat to a tubular frame. The clip is a spring clip formed from a stamped piece of metal. Variations of the clip mechanism include U.S. Pat. No. 2,302,969 to R. F. McMahan wherein a chair structure comprising two vertical side frames joined by rungs.

Other simple means of attaching a seat and backrest to a chair frame includes U.S. Pat. No. 275,823 to H. S. Hale which discloses a chair having an upper portion consisting of a tie rod and the lower portion consists of a crossbar. Attached to the tie rod is a back cushion frame, which communicates with the tie rod by a semicircular member that sits over the tie rod.

U.S. Pat. No. 2,783,828 to B. R. Weill also discloses a simple means of attaching a chair component to a chair frame. A seat and backrest cushion having front and rear face panels are connected to the chair by a flat elongated flexible strip, which is supported by the rear face panel of each cushion.

Various other attachment means have also been devised. For example, U.S. Pat. No. 2,829,707 to S. Liebson, U.S. Pat. No. 3,989,300 to J. M. Heumann, U.S. Pat. No. 4,523,787 to W. R. Robinson disclose several methods of attaching seats and backrests to living room furniture, such as sofas and love seats. Additionally, U.S. Pat. No. 4,544,205 to J. Molnar shows a self locking cushion assembly, which is attached and removed from a seat shell. Lastly, U.S. Pat. No.

4,830,435 to L. M. Nemschofet al. describes a seating unit having a pair of supports spaced apart and connected by cross beams to a seat subassembly.

All of the above references use fastening mechanisms and other complicated assemblies that do not necessarily allow for easy manufacture, and/or assembly by a consumer. What is needed to meet the needs of consumers is a system that is easy to assemble. This chair would be easy to assemble without the need for special tools or skills, and would also be inexpensive to manufacture. Additionally, the chair would be constructed so that all constituent components are securely fixed to one another utilizing a simple design fashioned for easy assembly.

SUMMARY

It is therefore an object of the present invention to provide backrest chair components that are easily assembled by a consumer in desired combinations.

It is a further object of the present invention to provide backrest chair components that have fastening mechanism that firmly secures the chair components to the chair frame.

These and other objects and advantages of the present invention will be apparent to those of ordinary skill in the art upon inspection of the detailed description, drawings, and appended claims.

The chair backrest attachment of the present invention allows for easy assembly by consumers with no special equipment or skills. The present invention is also easily manufactured and eliminates the need for full assembly by the manufacturer since the chair is shipped without any padded upholstered chair components. In some instances, the manufacturer, however, may ship the chair in an assembled form. Thus, the present invention has the versatility of being assembled by the consumer, or in the alternative, at the factory by the manufacturer. The present invention also allows the manufacturer to produce a wider variety of chairs that would appeal to the consumer.

The backrest of the invention is preferably formed of two molded parts having a ribbed structure, which inherently provides a strong and firm backrest. The molded parts have multiple locking means, which add strength and durability. The ribbed structure provides guideways or channels for aiding in positioning the part on the chair support structure.

It is an object of the invention to provide a ribbed backrest, which is inherently strong and durable.

It is a further object of the invention to provide a two part backrest wherein the two parts are easily positioned for quick locking around the chair back support structure without requiring the use of any tools.

It is a further object of the invention to provide that each part be molded as one piece from any durable material such as a thermoplastic polymer.

DETAILED DESCRIPTION OF THE INVENTION

Figure 1:
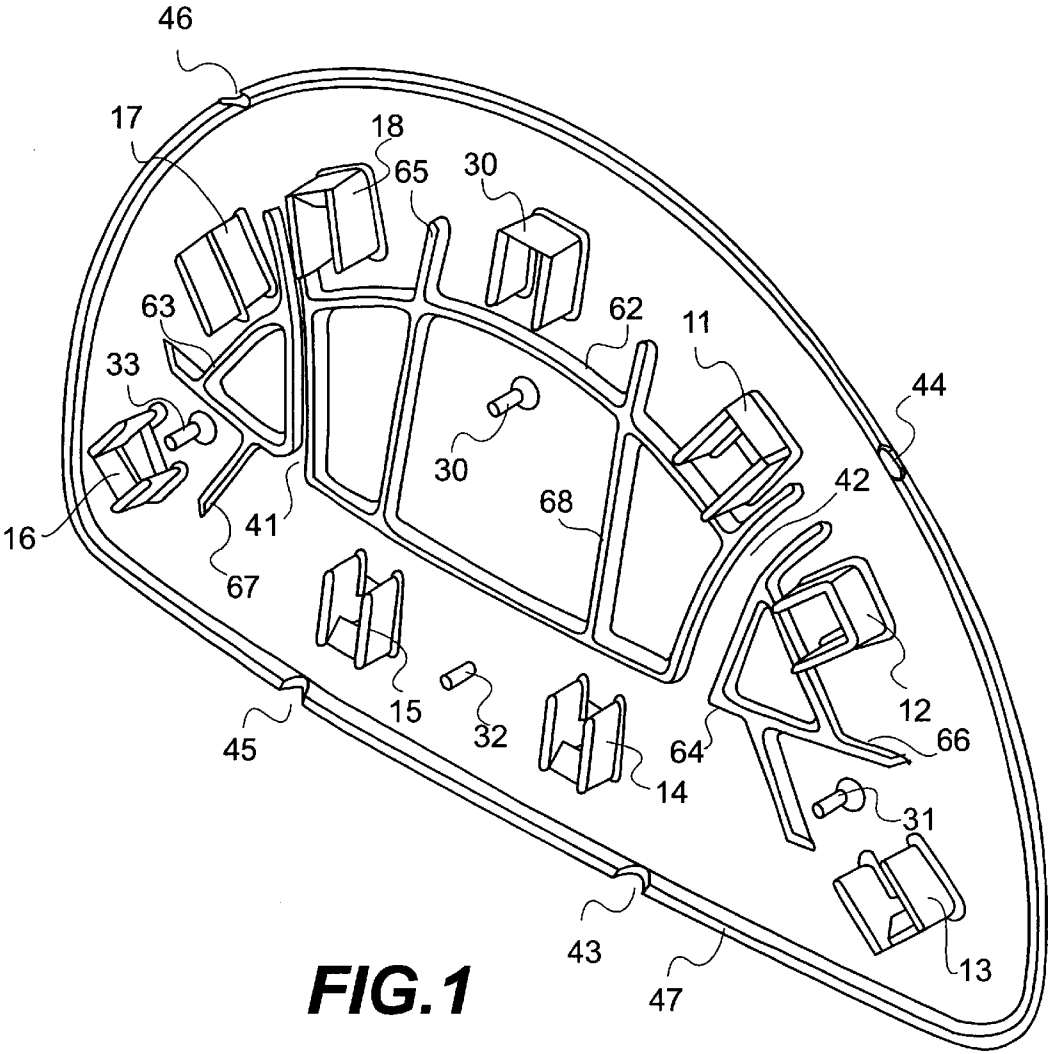
FIG. 1 shows the working parts of one piece of a backrest in accordance with one embodiment of the present invention.

The present invention is directed to a chair with attachable backrest components. The backrest components are constructed in such a manner to allow attachment to the chair without any tools. The attachable backrest is applied to chairs that have a rigid or sparse backrest. For example, some folding chairs have metal back structures. The back structures are either tubular or rod like. The backrest components of the present invention are added to such chairs to provide a solid backrest or support. Additionally, the backrest components can be added to provide a padded back support to the chair. While various illustrations are made with reference to folding chairs, the present invention is applicable to all chairs that do not have a solid back structure. The backrest components comprise two pieces, a front piece and a back piece. The two pieces of the backrest components are made of various materials including plastics and metallic sheets. Examples of suitable plastics include polyolefins, styrenics, vinylchlorides, or any combinations thereof. The front backrest piece is optionally contoured to match the chair structure and provide a more comfortable backrest. Since the back piece is not in contact with the seated person, the shape is dictated by aesthetics and interlocking support for the front piece. It is preferred that the back piece is of the same size and matching shape compared to the front piece.

The front and back pieces can be further covered with fabric and cushioning material. Since the interlocking mechanism operates by pushing the two pieces together, the backrest components are covered with cushions prior to assembly.

The pieces comprise at least two interlocking structures. The interlocking structures include any type that would bold the two pieces together. Separation of the pieces after assembly is not necessary but can be an optional requirement. Examples of interlocking structures include various forms of hook and catch mechanisms. A tubular receptacle and a mated prong with ridges can also be utilized. Spring-loaded catches can also be utilized. The important function is that the two pieces are connected together and held in place. The connection is preferably the type that would not require the utilization of any tools. This is desirable for the addition of cushioned backrest parts. The outside or external surface of a backrest component is covered with fabric and/or cushioning material. Thus, the interlocking mechanism functions by merely aligning the two parts and pushing them together. Tools are not needed. Further, the backrest components can be pre-covered with fabric or cushioning prior to assembly.

The number of interlocking mechanisms can vary but should be at least two in order to align and hold the two parts together. In one embodiment, the number of interlocking mechanisms is at least six and preferably about nine. Each piece of the backrest components can have both the hook and catch (male and female) parts.

The backrest pieces optionally further comprise alignment components such as pins on one side and matching sockets on the other. The number of pins can vary depending on the particular chair design.

To enhance the fit of this added backrest components, channels and groves are notched into the pieces in order to accommodate a chair frame structure. Since these parts are preferably made of plastic material, the chair frame structure is taken into account in the mold design. Other support ridges are added for strength.

Figure 6:
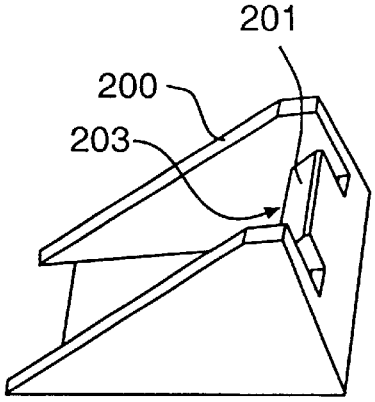
FIG. 6 shows a hook receiver (catch) structure in accordance with one embodiment of the present invention.
Figure 8:
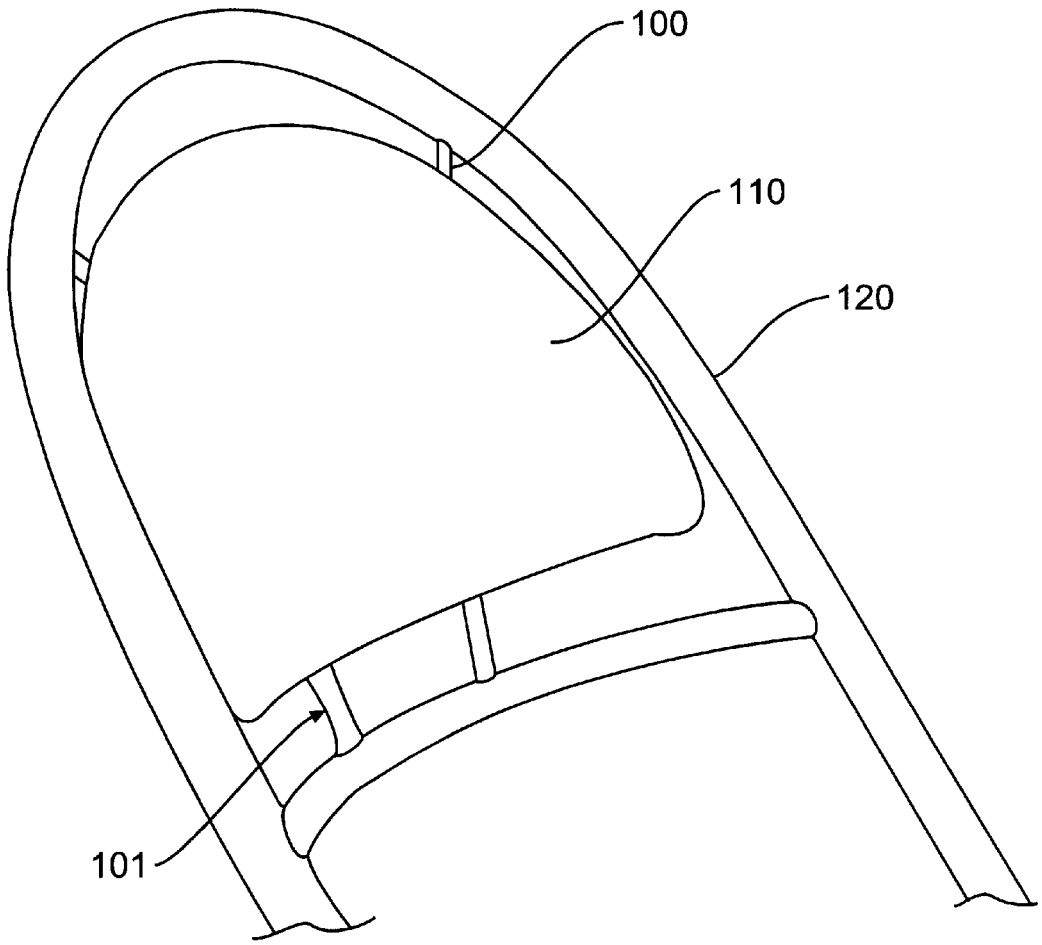
FIG. 8 is a view of a chair showing an example of a backrest support structure where the present invention is applicable.

FIG. 1 illustrates one embodiment of the present invention wherein one piece of the backrest comprises rib structures 62, 63, 64. Such rib structures add strength to the backrest. The rib structures are also utilized to form channels 41 and 42 which aid in positioning and locking the piece on or about the chair back supports. These channels 41 and 42 are for a backrest that fits a chair as shown in FIG. 8. Channels 41 and 42 fit around structure parts 100 and 101. Peripheral area 47 of the piece is curved and has notches 43, 44, 45 and 46 which further aid in positioning and locking the piece on or about the back supports. The specific position of these notches corresponds to elements 100 and 101 of the chair shown in FIGS. 4 and 8. This piece further has pins 30, 31, 32 and 33, which aid in aligning, positioning and locking the piece. These alignment pieces can be combined with the interlocking pieces. This piece has hook receiver means or catches 10, 11, 12, 13, 14, 15, 16, 17 and 18 for receiving the hooks of the other piece. The catches (one of which is shown in FIG. 6) have sloping surfaces which lead to recesses which receive the hooks of the other piece. The above-described pieces provide a backrest with increased strength and rigidity. The piece can be fitted with decorative cushioning before or after assembly or interlocking. Middle rib structure 62 has two dividers 68 and four spurs 65. End rib structure 63 has 3 spurs 67. End rib structure 64 has three spurs 66. The configuration of these rib structures can be varied and is for adding rigidity to the overall backrest.

Figure 2:
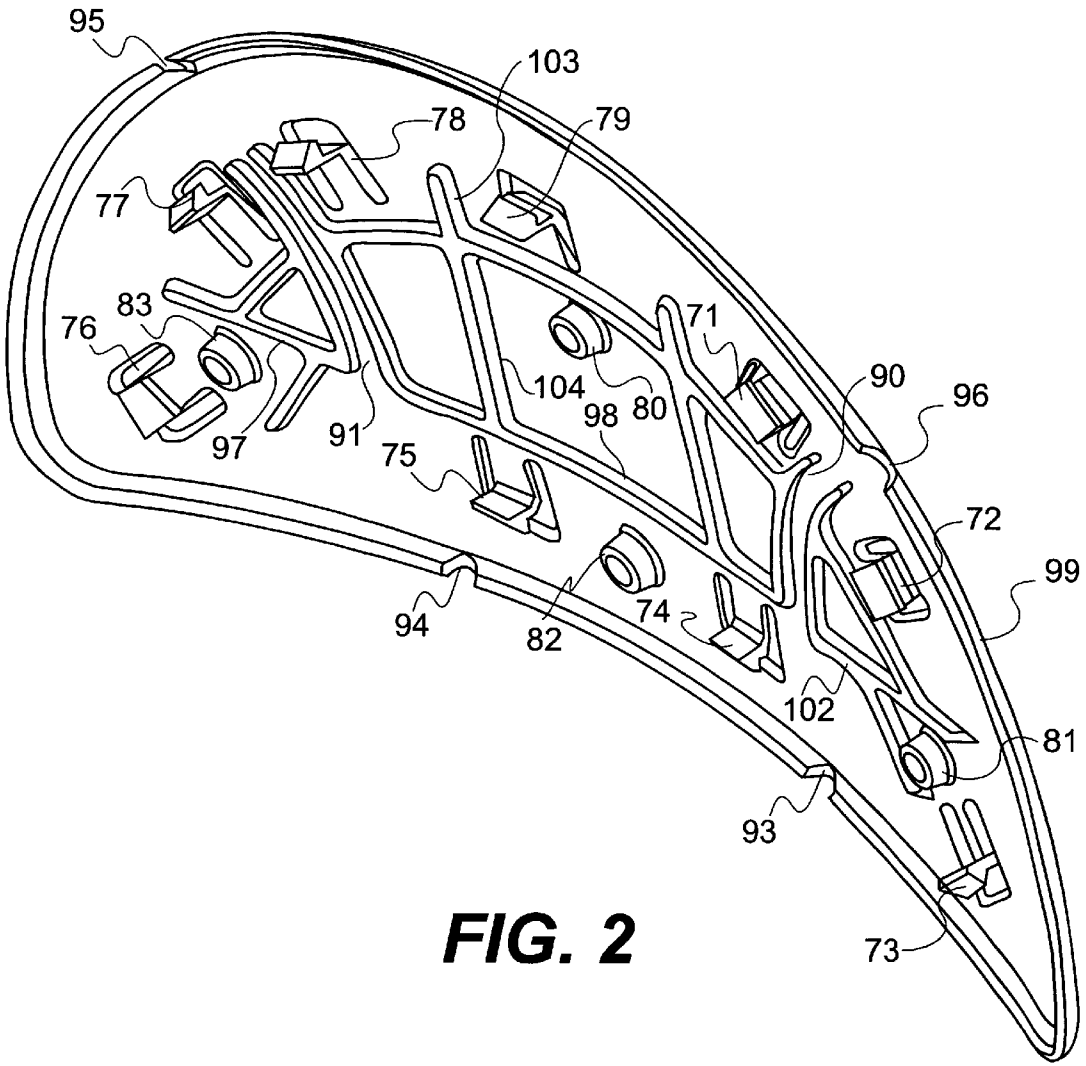
FIG. 2 shows the working parts of the other piece of the backrest to match the piece shown in FIG. 1.
Figure 7:
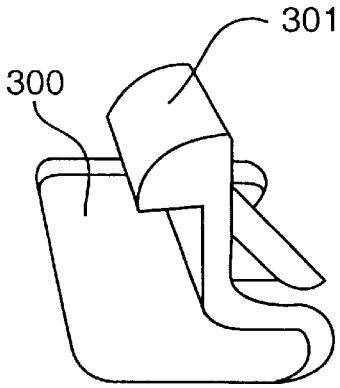
FIG. 7 shows a hook structure in accordance with one embodiment of the present invention.

FIG. 2 shows the other piece which has complementary hooks 71, 72, 73, 74, 75, 76, 77, 78 and 79, which snap fit into the catches previously described. Each piece can have a mixture of hooks and catches as long as a reciprocal part is found on the matching piece. Periphery 99 of this piece has notches 93, 94, 95 and 96 which match the notches of the first described piece; and channels 90 and 91 which match the above described channels. Hooks 71, 72, 73, 74, 75, 76, 77, 78 and 79 snap fit into the catches of the first piece. This piece has sockets 80, 81, 82 and 83 for receiving the pins of the one piece. Details of the hook are shown in FIG. 7. This second piece has rib structures 97, 98 and 102. Middle rib structure 98 has two dividers 104 and four spurs 103. End rib structures 97 and 102 have three spurs each.

Figure 1A:
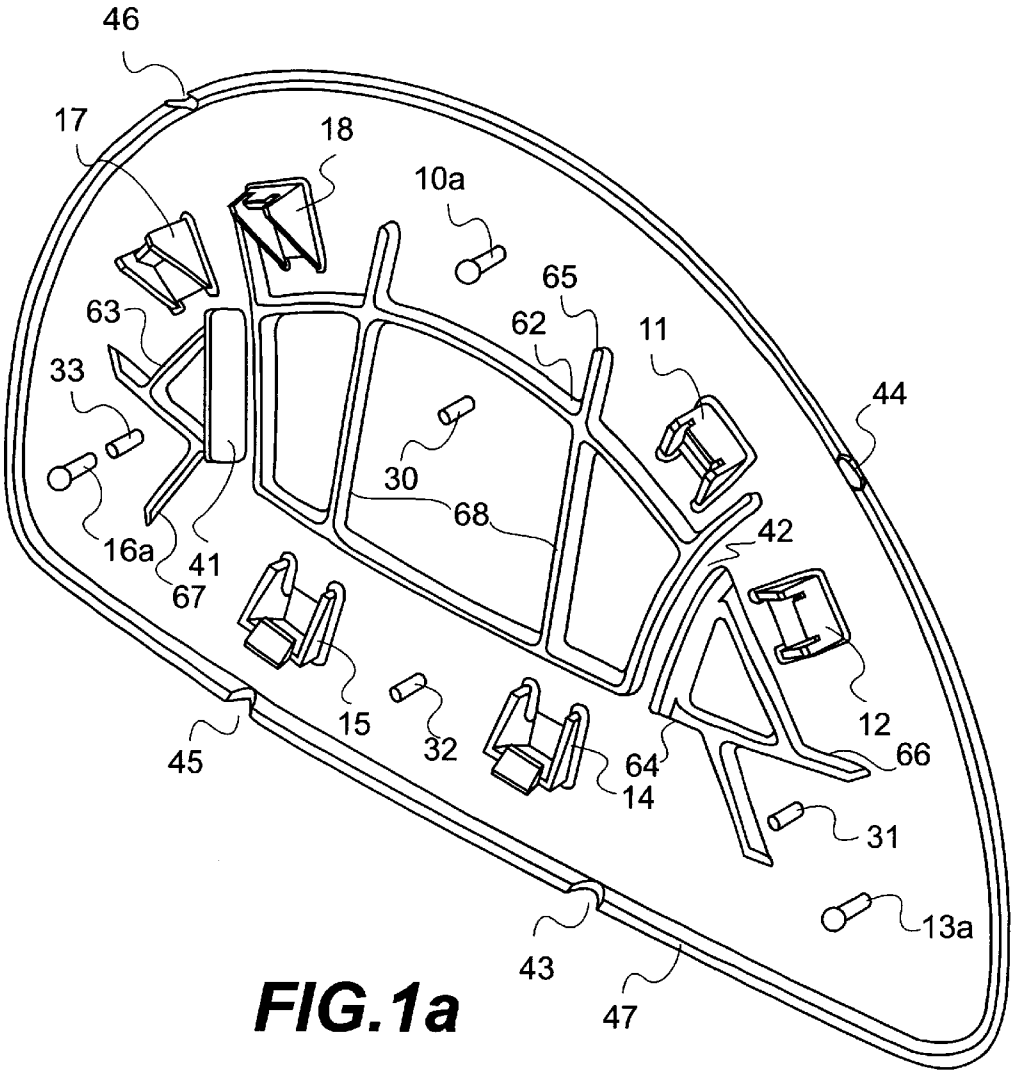
FIG. 1*a* shows the working parts of one piece of a backrest in accordance with another embodiment of the present invention.
Figure 2A:
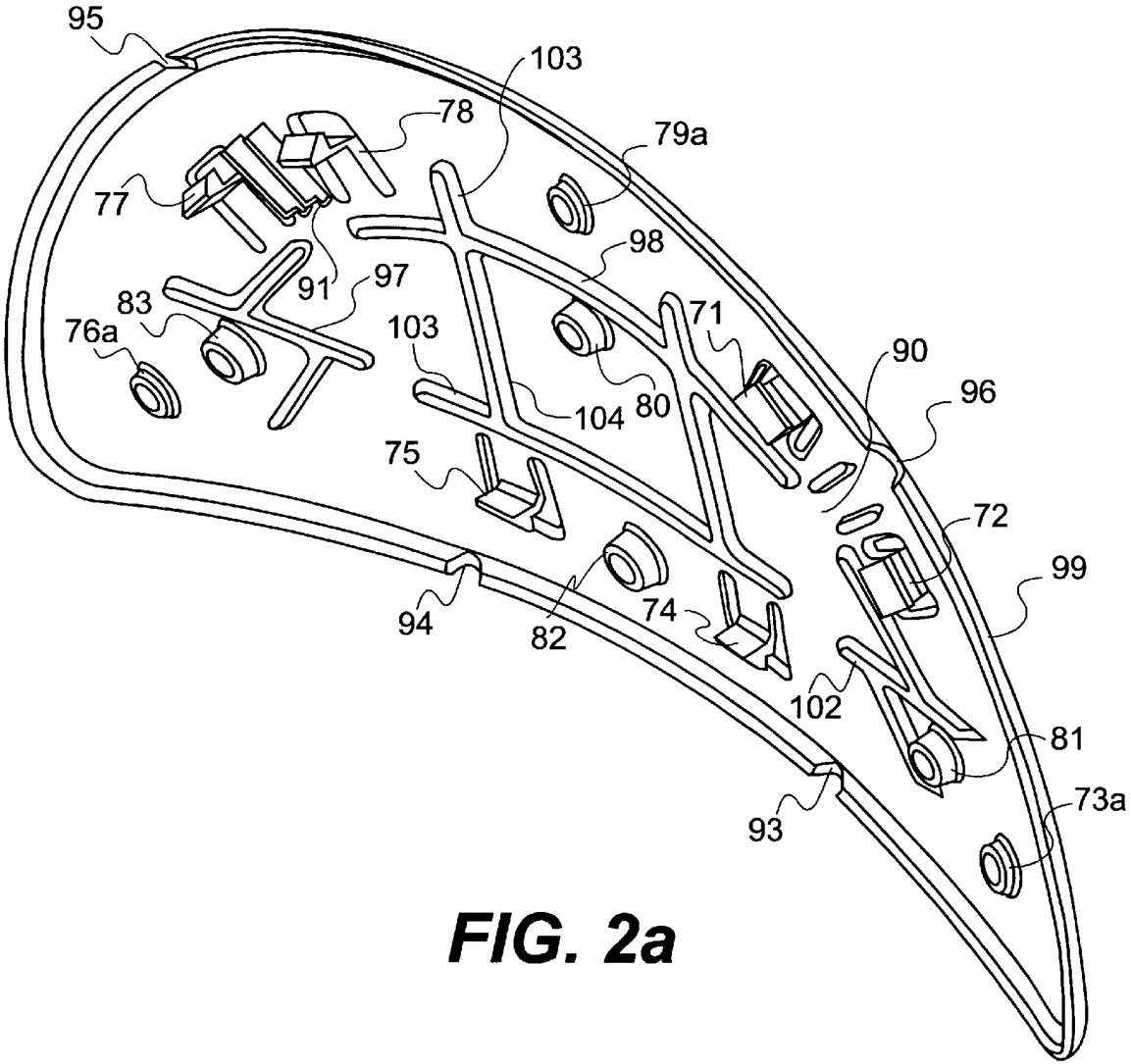
FIG. 2*a* shows the working parts of the other piece of the backrest to match the piece shown in FIG. 1*a*.
Figure 4:
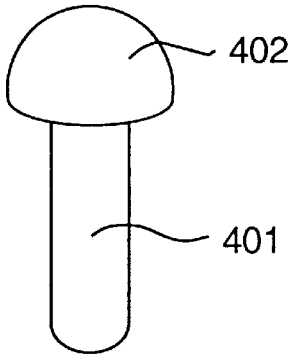
FIG. 4 shows a male part of a clasping or locking mechanism in accordance with one embodiment of the present invention.
Figure 5:
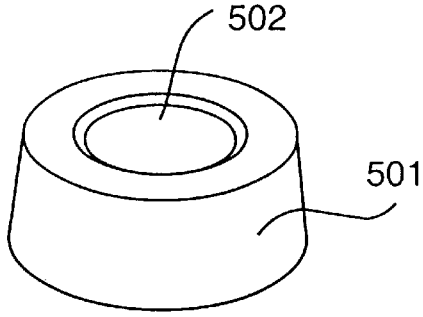
FIG. 5 is a receiver part of a locking mechanism in accordance with one embodiment of the present invention.

FIGS. 1*a* and 2*a* are similar to FIGS. 1 and 2 except for the replacement of some of the hook and catch structures with an interlocking mechanism as shown in FIGS. 4 and 5. Elements 10, 13 and 16 in FIG. 1 and replaced with elements 10*a*, 13*a* and 16*a* in FIG. 1*a*. Corresponding elements 73, 76 and 79 in FIG. 2 are replaced with elements 73*a*, 76*a* and 79*a* in FIG. 2*a*. These Figures show the ability to vary the type of interlocking mechanism utilized to hold the two pieces together.

It is preferred that both pieces be molded as one piece to form the various elements described above. The composition of the pieces may be any durable material although thermoplastics such as carbonates, styrene, polyethylene, vinyl chloride, etc. are preferred. It is apparent that each piece can also be a laminate or a composite material. A composite or laminate can include flexible polycarbonate hooks. The pieces can be made by injection molding or pressure molding.

The pieces shown in the drawing and described above, having nine hooks and nine hook catches, etc., make a very strong and durable backrest. However, a number of modifications are apparent. For instance, there can be more or less hooks, hook catches, sockets, channels, rib structures, etc. More than two pieces can be used if desired. Adhesives can be added to various parts to give added strength and durability.

Peripheral areas 47 and 99 of the two pieces are shown in the drawings as curved with no straight portions. Obviously the two pieces can have other shapes. They can be curved rectangular pieces with straight portions such as sides.

The rib structures of the drawings form a somewhat intricate pattern across a large portion of the surface areas of the two pieces. This provides great strength and stability. Obviously, the rib structures are subject to a number of modifications. For instance, the number of rib structures can be increased or decreased as desired. Because of the spurs and dividers, the rib structure peripheries can be considered irregular or discontinuous. The rib structure peripheries can be made regular or continuous by eliminating the dividers and spurs, and by using geometric shapes such as circles, rectangles, etc.

In the preferred embodiment, the pins are cylindrical. It is apparent that they can have other shapes. Similarly, the shapes of the hooks and catches can be changed as desired. The sockets are shown as circular with cylindrical openings. They can be square shaped to receive pins having square shaped cross-sections. The backrest supporting structure is shown in the drawings as bent and cylindrical rods. The supporting structure can be square rods or spokes. If the square rods are used, notches such as 43 in FIG. 1 would be rectangular in shape.

Decorative cushions can be applied to the pieces before or after assembly. Each piece can be covered with a composite of a cushioning material glued to the piece and an upholstery material glued to the cushioning material. In addition, the cushions can be made by vacuum forming a semi-rigid vinyl chloride sheet, placing the sheet and one of the pieces in a mold, and injecting an expandable polyurethane between the sheet and piece, and expanding the polyurethane to obtain the cushioned pieces.

Figure 3:
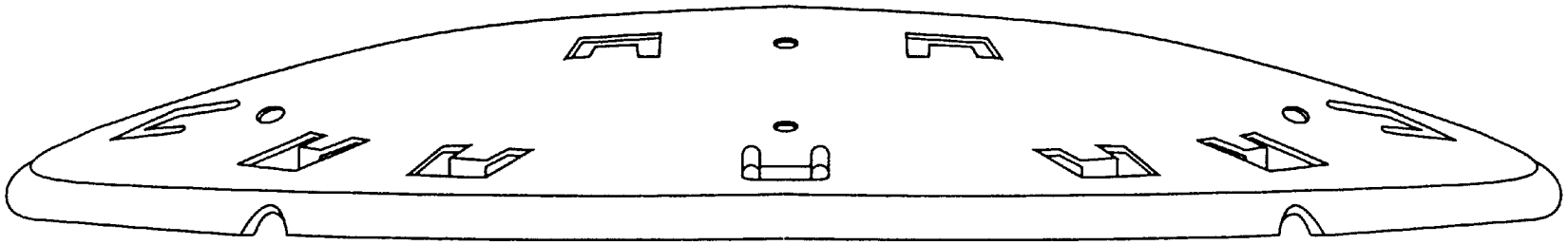
FIG. 3 shows the outside surface of the piece of the backrest in FIG. 2.
Figure 3A:
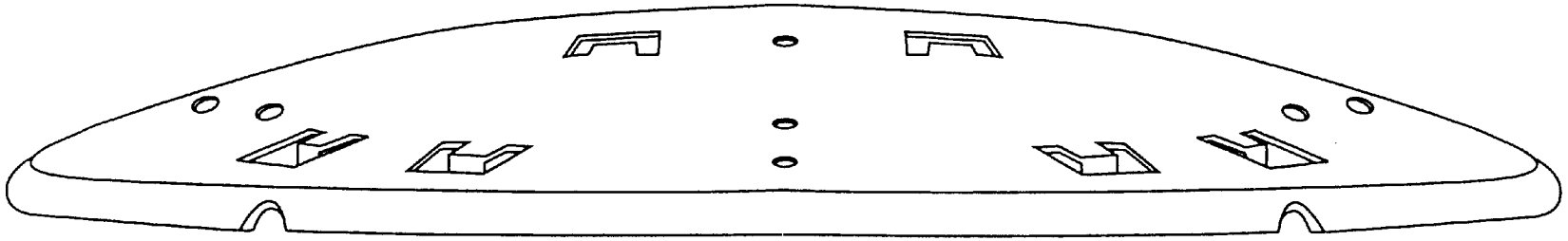
FIG. 3*a* shows the outside surface of the piece of the backrest in FIG. 2*a*.

FIG. 3 shows the outside surface of FIG. 2. FIG. 3*a* shows the outside surface of FIG. 2*a*. As can be seen, the outside surface is smooth and is void of any protrusions that can result in tearing of any optional covering fabric or cushion.

FIG. 4 shows the male or prong part for another clasping mechanism in accordance with another embodiment of the present invention. FIG. 5 shows the female or receiving part to match the prong shown in FIG. 4. The prong 401 extends from the surface of the chair back piece and terminates in tip 402. Tip 402 is shaped differently then stem 401 and includes a larger section. Tip 402 is forced into opening 502 of FIG. 5 and will snap together. In this embodiment, it is difficult to undo the clasping mechanism after attaching the back pieces to a chair back. The shape of part 402 can vary. Receptacle 502 is varied with prong 402. The shape of tip 402 can be spherical, for example, or any shape that provides a tip larger than the stem 401.

FIG. 6 shows the details of one of the nine catches. A catch housing 200 is provided with a sloping surface 201 on which a hook slides. The surface 201 leads to a recessed area 203 in which a hook is caught. It should be noted that the structure of these catches also serves as additional alignment structures. The function of these interlocking structures is to hold the two pieces together. Additionally, these structures allow the attachment of the two pieces without the need for additional screws, nails, brads, or other fastening means. Other types of interlocking mechanisms are various forms of spring loaded structures to spring a latch to a recessed receptacle.

FIG. 7 shows a hook element 300, which fits into the catch element of FIG. 6.

FIG. 8 shows an embodiment wherein the front 110 or the interlocked backrest is in place on inner frame members 100 and 101 located inside outer frame member 120. This embodiment shows a cushioned back support. As can be seen, the cushion covers the whole front part and the interlocking mechanisms. The front section 110 snaps together with the back section utilizing the interlocking mechanisms of the present invention.

The two pieces are assembled by placing the notches and channels against inner frame members 100 and 101, aligning the pins and sockets, and the hooks and catches; and snapping or pushing the pieces together.

Additionally or alternatively, the pieces of the invention can be used to mount various structures to various supports, for instance various signs, placards or posters to various posts or supports. Specifically, the pieces can form yard signs, floor signs, highway signs, railroad signs, picketing signs, political signs, etc. The at least two pieces can interlock to form a headrest or other furniture parts. Various structural elements can be formed by the at least two interlocking pieces.

The preferred embodiment of the present invention has now been described in detail. This description is merely illustrative of the principles underlying the inventive concept. It is therefore contemplated that various modifications of the disclosed embodiments will, without departing from the spirit and scope of the invention, be apparent to persons skilled in the art. For instance, it is obvious to one skilled in the art of the present invention that the interlocking pieces can form a self-supporting structure without the use of a supporting structure.

We claim:

1. A combination chair and backrest comprising:

a chair having a back formed with an outer frame member and at least two inner frame members; and a backrest formed of two mating pieces, wherein each of said two mating pieces has a finished side and an inner side, and wherein each inner side includes:

means for surface engagement with at least two of said at least two inner frame members to position each of said two mating pieces on opposite sides of said at least two inner frame members; and means for securing said two mating pieces to each other without tools.

2. The combination chair and backrest of claim 1 wherein the means for securing are hook and catch elements molded on the inner side of said two mating pieces.

3. The combination chair and backrest of claim 1 further comprising aligning elements on the inner side of said two mating pieces to guide the two mating pieces upon assembly.

4. The combination chair and backrest of claim 1 wherein the means for securing comprise nine interlocking elements and four aligning elements on the inner side of said two mating pieces.

5. The combination chair and backrest of claim 1 wherein said chair is a folding chair.

6. The combination chair and backrest of claim 1 wherein each of the two mating pieces is formed as a single molded piece.

7. The combination chair and backrest of claim 6 wherein each of the two mating pieces is molded from a thermoplastic material.

8. The combination chair and backrest of claim 1, further comprising cushioning covers on the finished sides of said two mating pieces.

9. The combination chair and backrest of claim 1, further comprising customizable covers on the finished sides of said two mating pieces.

10. The combination chair and backrest of claim 1, wherein the means for surface engagement comprise channels to fit around said inner frame members.

11. A method for combining a chair and backrest comprising:

providing a chair having a back formed with an outer frame member and at least two inner frame members;

forming a backrest from two mating pieces; and attaching said two mating pieces to said chair without tools, wherein each of said two mating pieces has a finished side and an inner side, and wherein mating is provided by said inner sides, which each include:

means for surface engagement with at least two of said at least two inner frame members to position each of said two mating pieces on opposite sides of said at least two inner frame members; and means for securing said two mating pieces to each other without tools.

12. The method of claim 11 wherein said inner sides further comprise aligning elements.

13. The method of claim 12 wherein the aligning elements comprise pin and socket structures.

14. The method of claim 11 wherein the means for surface engagement comprise channels to fit around said inner frame members.

15. The method of claim 11 wherein each of the two mating pieces is formed as a single molded piece of thermoplastic resin.

16. The method of claim 11 wherein each of the finished sides of the two mating pieces further comprise cushioning covers.

17. The method of claim 11 wherein the means for securing comprises snapping hooks into catches.

18. A backrest formed of two mating pieces, wherein each of said two mating pieces has a finished side and an inner side, and wherein each inner side includes:

means for surface engagement with at least two inner frame members of a chair back frame to position each of said two mating pieces on opposite sides of said at least two inner frame members; and means for securing said two mating pieces to each other without tools.

19. The backrest of claim 18 wherein the means for securing are hook and catch elements molded on the inner side of said two mating pieces.

20. The backrest of claim 18 further comprising aligning elements on the inner side of said two mating pieces to guide the two mating pieces upon assembly.

21. The backrest of claim 18 wherein the means for securing comprise nine interlocking elements and four aligning elements on the inner side of said two mating pieces.

22. The backrest of claim 18 wherein said chair back is from a folding chair.

23. The backrest of claim 18 wherein each of the two mating pieces is formed as a single molded piece.

24. The backrest of claim 23 wherein each of the two mating pieces is molded from a thermoplastic material.

25. The backrest of claim 18, further comprising cushioning covers on the finished sides of said two mating pieces.

26. The backrest of claim 18, further comprising customizable covers on the finished sides of said two mating pieces.

27. The backrest of claim 18, wherein the means for surface engagement comprise channels to fit around said inner frame members.

* * * * *